US008568057B2

(12) United States Patent
Rodriguez

(10) Patent No.: US 8,568,057 B2
(45) Date of Patent: Oct. 29, 2013

(54) FULL PRECAST TRAFFIC BARRIER AND INSTALLATION METHOD FOR MECHANICALLY STABILIZED EARTH WALL STRUCTURES

(76) Inventor: Joseph E. Rodriguez, Kissimmee, FL (US)

( * ) Notice: Subject to any disclaimer, the term of this patent is extended or adjusted under 35 U.S.C. 154(b) by 0 days.

(21) Appl. No.: 13/213,876

(22) Filed: Aug. 19, 2011

(65) Prior Publication Data

US 2012/0121324 A1 May 17, 2012

Related U.S. Application Data

(60) Provisional application No. 61/375,075, filed on Aug. 19, 2010.

(51) Int. Cl.
*E01F 15/08* (2006.01)

(52) U.S. Cl.
USPC ..... 404/6; 256/13.1; 405/286

(58) Field of Classification Search
USPC ..... 404/6; 256/13.1; 405/285, 286, 287, 405/287.1
See application file for complete search history.

(56) References Cited

U.S. PATENT DOCUMENTS

| | | | | |
|---|---|---|---|---|
| 4,684,287 | A * | 8/1987 | Wojciechowski | 405/287 |
| 4,806,044 | A * | 2/1989 | Duckett | 404/6 |
| 4,964,750 | A * | 10/1990 | House et al. | 404/6 |
| 5,119,614 | A * | 6/1992 | Rex | 52/649.3 |
| 5,131,786 | A * | 7/1992 | House et al. | 404/6 |
| 6,679,649 | B1 * | 1/2004 | Capolupo | 404/6 |
| 2002/0067951 | A1 * | 6/2002 | Paterson | 404/6 |

* cited by examiner

*Primary Examiner* — Gary Hartmann

(57) ABSTRACT

A traffic barrier including a precast base having a wall port capable of receiving an existing earth wall therein, a first row of rebar coupled to the base and extending outwardly away therefrom, and a second row of rebar coupled to the base and extending outwardly away therefrom. A moment slab is connected to the first and second rows of rebar in such a manner that a proximal end of the moment slab directly abuts flush against an anterior side of the base. A connects adjacent ones of the bases at an end-to-end pattern.

9 Claims, 5 Drawing Sheets

FULL PRECAST TRAFFIC BARRIER AND INSTALLATION METHOD FOR MECHANICALLY STABILIZED EARTH WALL STRUCTURES

CROSS-REFERENCE AND PRIORITY CLAIM TO RELATED APPLICATION

To the fullest extent permitted by law, the present U.S. Non-Provisional Patent Application claims priority to and the benefit of U.S. Provisional Patent Application entitled "Full Precast Traffic Barrier and Installation Method for Mechanically Stabilized Earth Wall Structures", filed on Aug. 19, 2010, on behalf of inventor Joseph E. Rodriguez, and having assigned Ser. No. 61/375,075, wherein the referenced application is incorporated by reference herein.

FIELD

The present disclosure generally relates to retaining wall construction comprised of mechanically stabilized earth elements, and more particularly to mechanically stabilized earthen structures requiring barriers with improved strength and installation properties.

BACKGROUND

It is generally known that mechanically stabilized earth (MSE) includes soil with artificial reinforcing. The MSE structures are used for retaining walls, bridge abutments, dams, seawalls, dikes, and the like, as illustrated by way of example with reference to FIG. 1. Although MSE structures have been used throughout history, MSE was developed in its current form in the 1960s. The reinforcing elements used vary but generally include steel and geosynthetics. As applied for reinforcing dwellings, dikes and levees, and many structures to prevent erosion of soil, modern use of soil reinforcing for retaining wall construction was first pioneered by French architect and engineer Henri Vidal. The first MSE wall build in the United States was done so in 1971 on State Route 39 near Los Angeles. It is estimated that since 1997, many more than 23,000 MSE walls have been constructed in the world.

Originally, long steel strips 50 to 120 mm (2 to 5 in) wide were used as reinforcement. These strips are sometimes ribbed, although not always, to provided added resistance. Sometimes steel grids or meshes are also used as reinforcement. Several types of geosynthetics can be used including geogrids and geotextiles. The reinforcing geosynthetics are typically made from high density polyethylene, polyester, and polypropylene. These materials may also be ribbed and come in varying sizes and strengths.

By way of further background and with reference to "Mechanically Stabilized Earth Wall Inspector's Handbook," State of Florida, Department of Transportation, Sep. 14, 2000, the disclosure of which is herein incorporated by reference in its entirety, established procedures for the construction of an MSE wall system. For example, during preparation of a site, the MSE wall footprint area including the zone of the wall facing, soil reinforcement and select backfill must be prepared. The foundation for the structure is graded level for a width at least equal to the length of soil reinforcement. Any soft or loose material that is encountered is stabilized. The wall system may comprise original ground, concrete leveling pad, wall facing panels, coping, soil reinforcement, select backfill, and any loads and surcharges. All of these items have an effect on the performance of the MSE wall and are taken into account in the stability analysis. A change in any of these items could have a detrimental effect on the wall.

For MSE wall installation, once the area has been properly prepared, a concrete leveling pad is typically poured in place. Coping is used to tie in the top of the wall panels and to provide a pleasing finish to the wall top. The coping can be cast-in-place or prefabricated segments. A filter fabric is typically used to cover the joint between panels, and is typically placed on the backside of the panels. This keeps the soil from being eroded through the joints and allows any excess water to flow out. Random backfill may be allowed in normal embankment construction. Select backfill meeting the gradation, corrosion, unit weight, internal friction angle and any other requirements of the specifications will typically be used. Soil reinforcement will be used to hold the wall facing panels in position and to provides reinforcement for the soil. The reinforcement can be made of steel (inextensible materials) or polymers (extensible materials). Wall panel spacers are used and are typically ribbed elastomeric or polymeric pads inserted between the panels. The panels or panels are used to hold the soil in position at the face of the wall and are typically formed in concrete but they can be metal, wood, block, mesh or other material.

The present disclosure is directed at least partially to the coping, which can be required to meet stringent barrier requirements depending upon placement of use. As generally described in the above referenced MSE Wall Inspector's Handbook, precast or cast-in-place coping barriers may be used. For precast units, a leveling course of concrete is placed prior to setting the units in place as illustrated with reference to FIG. 2. This provides the vertical control needed for installation of the coping. Precast barriers are typically tied together and strengthened against vehicle impact by a slab cast typically in 30-foot sections as illustrated with reference to FIG. 3.

By way of further example regarding needs in the industry, the use of one full precast traffic barrier (FPTB) positioned on a top of an MSE wall was discontinued by the Florida Department of Transportation (FDOT) and the Federal Highway Administration (FHWA) because the typical structure did not meet impact loading criteria established by the FHWA. By way of example, where previously a barrier needed to withstand being hit be an automobile traveling at 55 mph, current regulations require the ability to withstand a head-on impact by a truck traveling at 65 mph.

Therefore, it is readily apparent that there is a need for an improved FPTB and MSE structure that can meet current impact criteria on FDOT projects and still enable the cost and time efficient installation of a precast barrier. It is to that purpose the following embodiments are herein disclosed.

BRIEF SUMMARY

Briefly described, in a preferred embodiment, the present device overcomes the above-mentioned disadvantages and meets the recognized need by providing an full precast traffic barrier and installation method and mechanically stabilized earth wall structures, wherein reinforcing elements formed with adjoining concrete slabs (such as rebar) at an interface between the FPTB section and the slab provide a counter weight element to the slab and enable increased resistance to overturning upon impact.

According to its major aspects and broadly stated, in its preferred form, the present precast barrier incorporates joint reduction, increased rebar concentration, increased rebar strength, increased moment slab width, and increased concrete strength to meet Test Level 4 (TL-4) impact loading requirements of the Federal Highway Administration.

More specifically, the device of the present disclosure in its preferred form is a full precast traffic barrier (FPTB) for use on top of an MSE wall, wherein a plurality of reinforcing elements, such as rebar, are formed with adjoining concrete slabsat an interface between the FPTB section and the slab, acting as a counter weight element. Preselected length dimensions for slabs are preferred to achieve enhanced structural integrity by strategically minimizing joints. Relative to length, FDOT requires a minimum of 12 feet for TL-4, wherein previously the minimum was 10 feet. The preferred embodiment of the present disclosure, for long straight wall installation, is preferably 15 feet. By way of example, a barrier section with a five (5) foot length is preferred for use on radius turns; a section with a ten (10) foot length is preferred for straight runs; and, as noted, a fifteen (15) foot barrier section is preferred for projects that have long straight walls that permit installation of longer barriers. Of course, one skilled in the art now having the benefit of the teachings of the present disclosure could select a different barrier length, although such selection would impact on the overall strength of performance for the constructed barrier structure, wherein it is the combination of preferred features that delivers the unexpectedly improved impact tolerance to the preferred traffic barrier of the present disclosure.

For aesthetic preference accommodation, precast embodiments may alternately include a chamfer rustication to make them appear to be five (5) feet wide, or to display any other surface enhancement as may be desirable.

Another alternate embodiments is a variation of the preferred full precast traffic barrier (FPTB) for use on top of an MSE wall, but with a dowel employed for further connecting FPTB sections together, using the dowel and an epoxy to securing the dowel within an aperture of each barrier. In such an embodiment, the dowel spreads the impact loading between adjoining barrier sections. Installing and connecting the dowel for such an embodiment may include drilling existing precast units, casting the barrier with a void for the dowel on each end of the barrier, or using a threaded insert and a threaded bar on one side of the barrier and inserting the threaded bar into a void on the other side of the barrier with epoxy connecting the dowel to the barrier, for example.

It is important to note that a single dowel or a plurality of dowels may be utilized, but also to note that the dowels are not a necessity for the precast barrier of the present disclosure to achieve and meet the TL-4 impact loading requirements. The dowels may be incorporated, where desired, to internally link adjacent FPTB sections. That is, in order to conceive and create a precast barrier capable of meeting the new TL-4 requirements, and beneficially eliminate the expense and time commitment of on-site barrier pours, the present disclosure describes the following improvements: (1) increasing the length of the barrier to reduce the number of joints; (2) increasing the amount of rebar and the rebar strength in the barrier design; (3) increasing the moment slab width and rebar amount to meet the TL-4 requirements; (4) increasing the concrete strength; and, as noted as a further option, (5) adding dowels to attach the barrier for special cases, including TL-5 applications.

Accordingly, a feature and advantage of the present device is its ability to withstand greater impact than previously achieved by any precast barrier.

A feature and advantage of the present method is its ability to eliminate the time-inefficient and costly method of on-site forming and pouring of traffic barriers.

Yet another feature and advantage of the present device is its ability to meet a TL-4 impact requirement without need for an interconnecting dowel, and to meet a TL-5 impact requirement with incorporation of an interconnecting dowel.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

The present device will now be described more fully hereinafter with reference to the accompanying drawings, in which embodiments of the present device are shown. The invention may, however, be embodied in many different forms and should not be construed as limited to the embodiments set forth herein. Rather, the embodiments herein presented are provided so that this disclosure will be thorough and complete, and will convey the scope of the invention to those skilled in the art. In describing the preferred and alternate embodiments of the present device, as illustrated in the figures and/or described herein, specific terminology is employed for the sake of clarity. The device, however, is not intended to be limited to the specific terminology so selected, and it is to be understood that each specific element includes all technical equivalents that operate in a similar manner to accomplish similar functions.

The use of known TL-3 Full Precast Traffic Barrier (FPTB) structures on top of MSE Walls was discontinued by the Florida Department of Transportation (FDOT) and the Federal Highway Administration (FHWA) because the structures did not meet new criteria of a TL-4 impact loading established by FHWA. As a result, traffic barrier installation was relegated to costly on-site forming and pouring. Embodiments of the present disclosure are presented that meet the TL-4 FPTB requirements of the FDOT. That is, the device and installation method of the present disclosure allows for use of FPTB and to still meet the TL-4 Impact criteria on FDOT Projects and other related projects.

Figure 1:
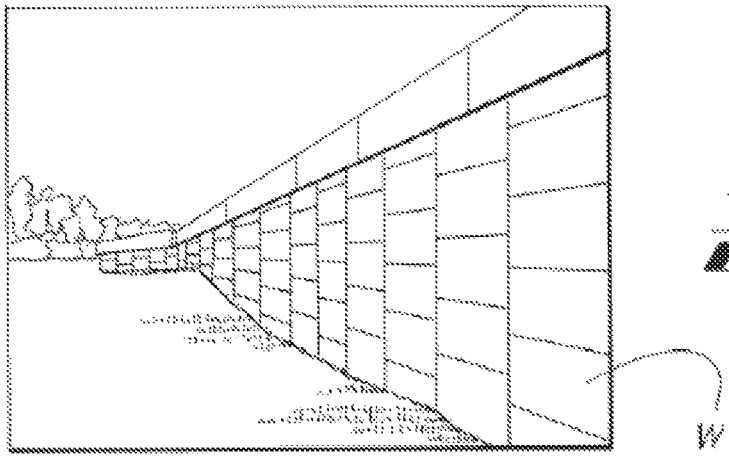
Fig. 1 PRIOR ART
FIG. 1 is a perspective view of awell knownprior art MSE wall structure.
Figure 2:
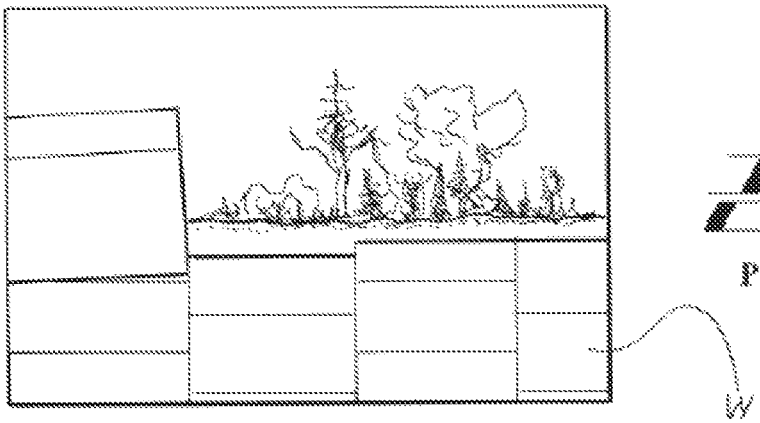
Fig. 2 PRIOR ART
FIG. 2 is a front view of a typical coping on a prior art MSE wall.
Figure 3:
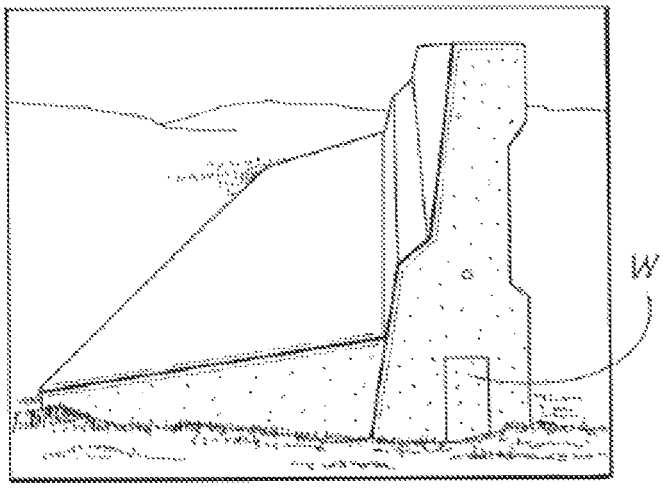
Fig. 3 PRIOR ART
FIG. 3 is an end view of one well known prior art barrier structure used on an MSE wall according to the teachings of one Mechanically Stabilized Earth Wall Inspector's Handbook (published Sep. 14, 2000 by State of Florida Department of Transportation)
Figure 4:
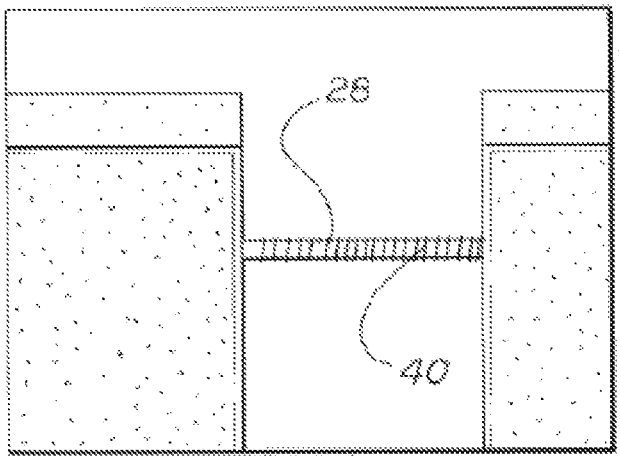
FIG. 4 is a partial view of a traffic barrier according to an embodiment of the present disclosure, showing a dowel glued into place in one dowel hole of a first barrier section with an adjacent barrier section in position to receive the dowel in its dowel hole upon being slid closer to the first barrier section.
Figure 5:
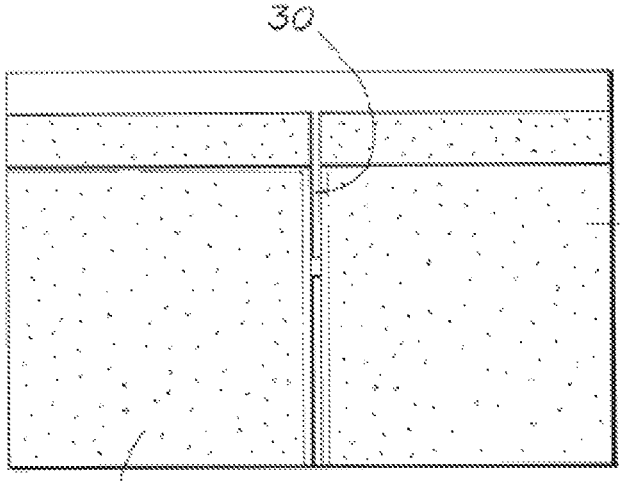
FIG. 5 is a partial view of the traffic barrier of FIG. 4, showing the adjacent barrier sections in an abutting position and having a dowel connection therebetween.
Figure 10:
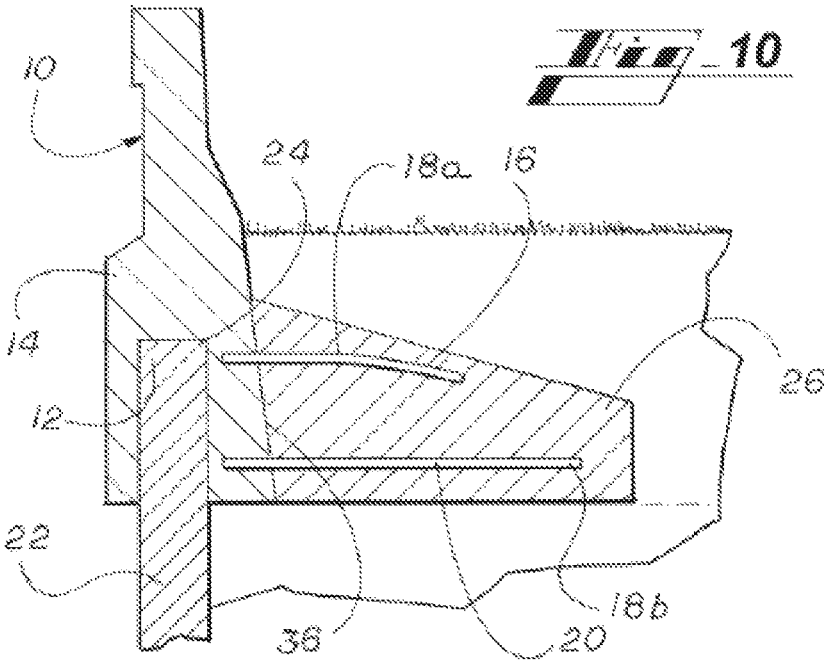
Figure 11A:
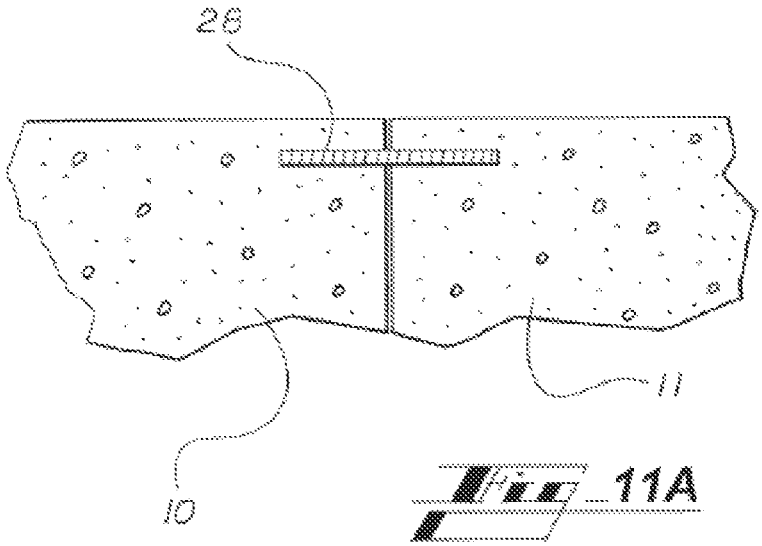
FIG. 11A is a partial cross-sectional view of adjacent barrier sections of a traffic barrier according to an embodiment of the present disclosure, showing a single dowel connected therebetween.
Figure 11B:
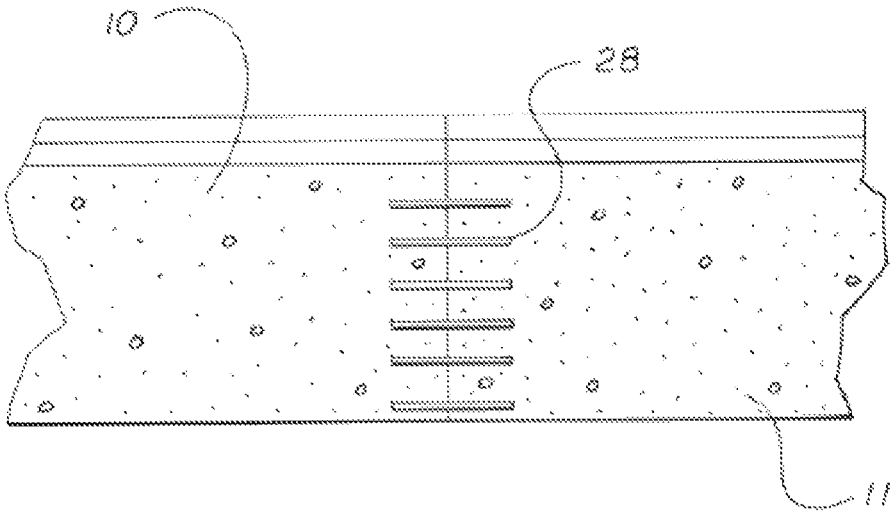
FIG. 11B is a partial cross-sectional view of adjacent barrier sections of a traffic barrier according to an embodiment of the present disclosure, showing a plurality of dowels connected therebetween.

For aid in understanding the improvements, initial reference is made to FIGS. 2 and 3, showing an MSE wall W according to the prior art, and to FIG. 10, illustrating a cross-sectional view of the preferred embodiment according to the present disclosure. Full precast traffic barrier 10 is preferably generally key-shaped, with wall port 12 defined within base 14, and preferably with first row 16 of plurality of rebar 18*a* and a second row 20 of plurality of rebar 18*b*. This preferred form is precast, offsite, and conveniently delivered for installation according to the preferred method relative to a mechanically stabilized earth wall 22.

Figure 6:
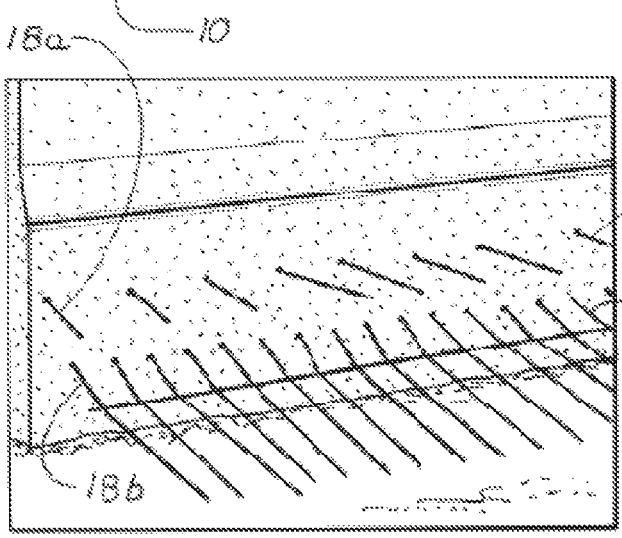
FIG. 6 is a partial perspective view of a traffic barrier according to an embodiment of the present disclosure, showing rebar extending from a barrier section prior to being embedded into a concrete slab yet to be poured in place.
Figure 7:
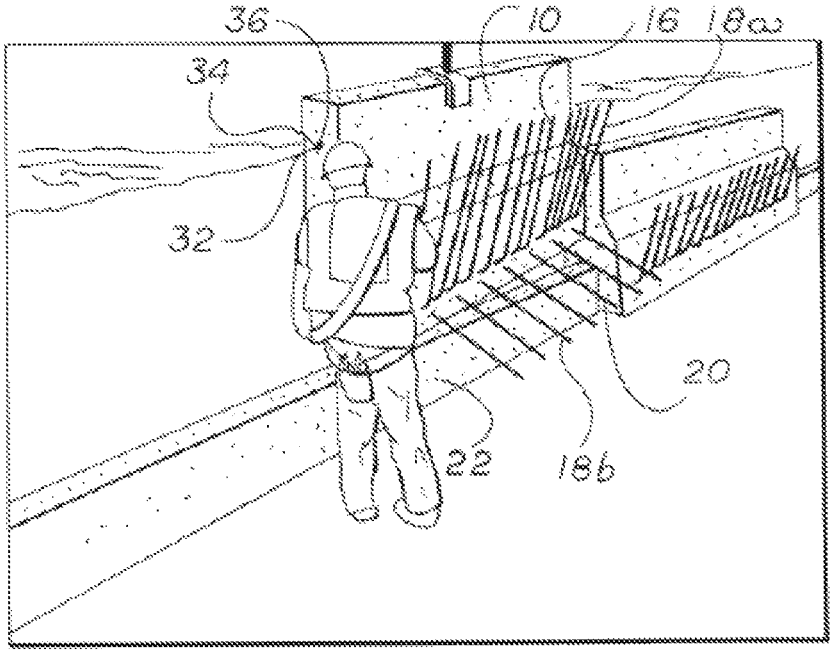
FIG. 7 is a perspective view of a traffic barrier according to an embodiment of the present disclosure, showing a barrier section being lowered into place on a portion of an MSE wall.

As is representatively illustrated in FIGS. 6 and 7, first row 16 of plurality of rebar 18*a* is preferably a series of equally spaced elongate rebar 18*a*, preferably parallel relative to each other, and preferably perpendicular to the vertical installation position of full precast traffic barrier 10. First row 16 is preferably positioned proximate inner support wall 24 of wall port 12, and second row 20 is preferably positioned proximate base 14. Also, second row 20 of plurality of rebar 18*b* is preferably a series of equally spaced elongate rebar 18*b*, preferably parallel relative to each other, and preferably perpendicular to the vertical installation position of full precast traffic barrier 10. As shown in FIG. 6, rebar 18*a* is preferably of stronger form and greater diameter than rebar 18*b*; however, it should be noted that rebar 18*a* and rebar 18*b* could be of the same strength and diameter, or rebar 18*b* could be of stronger form and greater diameter than rebar 18*a*.

As demonstrated in FIG. 7, for ease of installation of FPTB 10 onto MSE wall 22, first row 16 of plurality of rebar 18*a* is preferably positioned in an upwardly extending position and second row 20 of plurality of rebar 18*b* is preferably positioned in an outwardly extending position. Thereafter, rebar 18*a* and 18*b* are repositioned for incorporation into poured concrete moment slab 26.

In the preferred embodiment, and with reference to FIGS. 6 and 10, another feature that combines to deliver the beneficial impact strength for FPTB 10 to meet TL-4 impact loading requirements is rebar 18*a* and 18*b* preferably redesigned to be stronger especially at interface 36 between FPTB 10 section and moment slab 26 which acts as a counter weight to resist the overturning of the FPTB 10 when impacted in a crash.

With reference again to FIGS. 6 and 10, and now to FIG. 7, and as noted, first row 16 (top) and second row 20 (bottom) rebar 18*a* and 18*b*, respectively, may be varying length. By way of example, the first row 16 may be of longer rebar 18*a* than the second row 20, the second row 20 longer than the first row 16, or generally of the same length. It is understood that multiple rebar 18 will be employed and extend generally along a uniform line, but such an alignment is not required.

As previously noted, concrete strength is also preferably enhanced for FPTB 10, again enhancing the overall achieved impact strength in combination with the other preferred features. Preferably, concrete strength in FPTB 10 and moment slab 26 are increased from 4,000 pounds per square inch (psi) to 6,000 psi, as classified by a compressive strength test. This increase may be accomplished by increasing the solids in the mixture (i.e. more cement, less water). Also, it is preferred that the concrete tension is also increased, such as by increasing the size of the reinforcing bars (rebar 18). The rebar size typically varies in diameter by eighths, such that ⅛ rebar is #1 rebar, ⅜ rebar is #3 rebar, etc. Of course, the size of the rebar increases the strength because it is bigger and stronger. This combination of enhanced materials assists in formation of a stronger unit that can withstand a greater impact load. It should be noted that the number of rows of rebar 18 or the spaced concentration of rebar 18 per lineal foot could be increased. Increased quantity of rebar per spatial zone may be preferred.

The use of one or more dowel(s) 28 may be optionally employed, connecting between adjacent sections of FPTB 10; however, as noted, this is optional. For example, TL-5 impact requirements may be met by incorporation of one or more dowel(s) 28 at each juncture 30, or a particular installation location may benefit from selective inclusion of dowel(s) 28. As demonstrability illustrated with reference to FIGS. 4, 5, 11, and 12, one or more dowel(s) 28 serve to connect adjacent FPTB 10 sections together, wherein each dowel 28 is positioned within a dowel hole 32 in each FPTB 10, and may be further secured in place, such as by using adhesive epoxy 34. Each dowel 28 spreads the impact loading between the adjoining FPTB 10 sections instead of onto one individual barrier.

Figure 8:
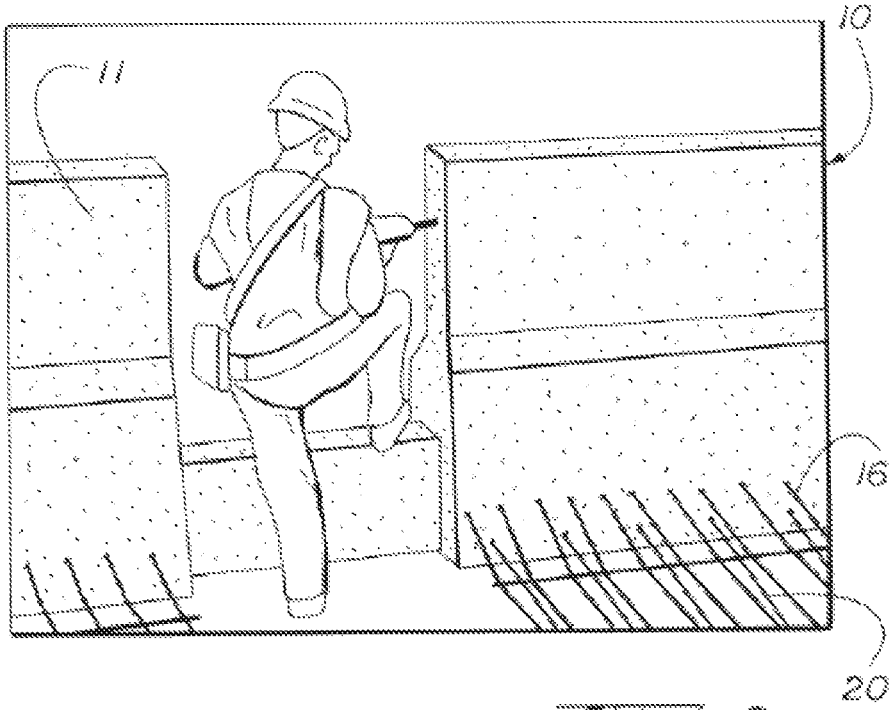
FIG. 8 is a perspective view of a traffic barrier according to an embodiment of the present disclosure, showing barrier sections carried by an MSE wall prior to be slid to an abutting position, and showing dowel holes being prepared for insertion of a dowel.

As illustrated with reference again to FIG. 7 and now to FIG. 8, the connector dowel(s) 28 may be installed by drilling existing FPTB 10 units, casting alternate FPTB sections 11 with a void 36 for the dowel 28 on each side of the FPTB 10 or using a threaded insert 38 and a threaded bar 40 on one side of the FPTB 10 and inserting the threaded bar 40 into a void 36 on the other side of the FPTB 10, with epoxy 34 connecting the dowel 28 to the FPTB 10. As illustrated with reference to FIG. 12, multiple dowel holes or voids 36 and dowels 28 may be employed as desired.

With reference again to FIG. 7, by way of example, each FPTB 10 section is preferably 5 feet wide (on a radius), 10 feet wide (typical size) or 15 feet wide for projects that have long straight walls that allow for the longer units. Moreover, each FPTB 10 may include a chamfer rustication 42 to make them appear to be 5 feet wide should aesthetics be important.

FIG. 15 is an illustration of the preferred embodiment of the present disclosure, showing preferred dimension reference points and lines for assessment of impact tolerance, as referenced in the following calculations and Table. That is, the following Table is a compilation of data related to external stability, and reports weights and moments about a Point A, with fifty foot (50') sections between expansion joint in moment slab.

| Area | Calculation | Magnitude | Arm | Moment |
|---|---|---|---|---|
| 1 | 0.82' × 1.1' × 50' × .150 kcf | 6.786 | −0.385 | −3.70kip-ft |
| 2 | 0.71' × 1.48' × 50' × .150 kcf | 7.881 | −0.25 | −2.97kip-ft |
| 3 | 1.83' × 0.188' × 0.5' × 50' × .150 kcf | 1.290 | 0.042 | 0.05kip-ft |
| 4 | 0.63' × 0.417' × 50' × .150 kcf | 1.970 | 0.306 | 0.60kip-ft |
| 5 | 0.63' × 0.188' × 50' × .150 kcf | 0.888 | 0.875 | 0.78kip-ft |
| 6 | 1.52' × 0.85' × 50' × .150 kcf | 9.690 | 0.24 | 2.33kip-ft |
| 7 | 1.25' × 0.40' × 50' × .150 kcf | 3.750 | −0.49 | −1.84kip-ft |
| 8 | 1.25' × 0.46' × 50' × .150 kcf | 3.188 | 0.523 | 1.67kip-ft |
| 9 | 1' × 5.5' × 0.5 × 50' × .150 kcf | 20.625 | 2.64 | 54.45kip-ft |
| 10 | 0.75' × 5.5' × 50' × .150 kcf | 30.9375 | 4 | 123.75kip-ft |
| | Summation | 86.98kip | | 177.21kip-ft |

Calculating a factor of safety against overturning involves dividing the resisting moment, 171.21 kip-ft, by the driving moment, 99.01 kip-ft, to arrive at an overturning safety factor of 1.79, which is greater than 1.0. Similarly, calculating a factor of safety against slide involves adding the coefficient of friction (taken from AASHTO Table 5.5.2B) and the resisting forces and dividing by the driving force (impact load), to arrive at the sliding safety factor of 1.93, which is also greater than 1.0.

Additional supporting calculations confirming the safety of the FPTB 10 relative to forces received are represented:

With design parameters as follows:

60 ksi=$f_y$ 5.5 ksi=$f_c$ 54 kips=TL-4

To check section A-A of FIG. 15:

$d_b$−assume $W15.4$=0.443 in $b_w$=15 ft

Computing the moment:

54 kips×1.83' per 15' of barrier=98.82 kip-ft

Computing the depth of section:

$d=t-2''-(d_b/2)=8.53$ in $M_n=0.9\times[A_s\times f_y\times d(1-0.6p\times f_y/f'c)]/12$ p=$A_s/b_w\times d$ p=0.0007 $A_s$ 0.6 p=0.0004 $A_s$ Finally, solving Moment in terms of $A_s$:

$12\times 98.82=0.9A_s(60)(8.53)[1-0.0004As(60/3.5)]$ $1185.8=460.6A_s-2.0A_s^2$ $A_s$=2.60 in$^2$ $A_{s\ required}$=2.6 in W15.4 @ 4" O.C.=0.462 in$^2$/ft Over 15' length, $A_{s\ provided}$=6.93 in$^2$ $A_{s\ provided}>A_{s\ required}$ To check shear:

$V_c=2\times sqrt(f_c)\times b_w\times d=227.70$ kips $V_u$=54 kips $V_c>V_u$

Additionally, to check Section B-B of FIG. 15:

$d_b$−assume $W15.4$=0.443 in $b_w$=15 ft

Computing the moment:

54 kips×3.29' per 15' of barrier=177.66 kip-ft

Computing the depth of section:

$d=t-2''-(d_b/2)=6.53$ in $M_n=0.9\times[A_s\times f_y\times d(1-0.6p\times f_y/f'c)]/12$ p=$A_s/b_w\times d$ p=0.0009 $A_s$ 0.6 p=0.0005 $A_s$ Finally, solving Moment in terms of $A_s$:

$12\times 177.66=0.9A_s(60)(6.53)[1-0.0005As(60/5.5)]$ $2132=352.6A_s-1.92A_s^2$ $A_s$=6.26 in$^2$ $A_{s\ required}$=6.26 in$^2$ Due to combined tension and flexure, increase the $A_s$ required by the tension calculated below=6.91 in$^2$ $W15.4@4''O.C.=0.462$ in$^2$/ft Reduce Varigrid strength since the W15.4@4" is at a 31 degree angle from perpendicular to the critical plane, 0.396 in$^2$/ft.

W15.4 over 15' length, $A_{s\ provided}$=7.95 in$^2$ (at a 38 degree angle to the critical plane)=6.27 in$^2$ Over 15' length, Total $A_{s\ provided}$=12.21 in$^2$ $A_{s\ provided}>A_{s\ required}$ To check shear:

$V_c=2\times sqrt(f_c)\times b_x\times d=174.30$ kips $V_u$=54 kips $V_c>V_u$

Check tension reinforcement at Moment slab and barrier:

Tension force applied: 54 kips $A_s$ required across 15' barrier: 1.29 in$^2$ (54 kips/$f_y$/0.7)

$A_s$ provided (#6@10"): 7.95 in$^2$ $A_{s\ provided}>A_{s\ required}$

Figure 9:
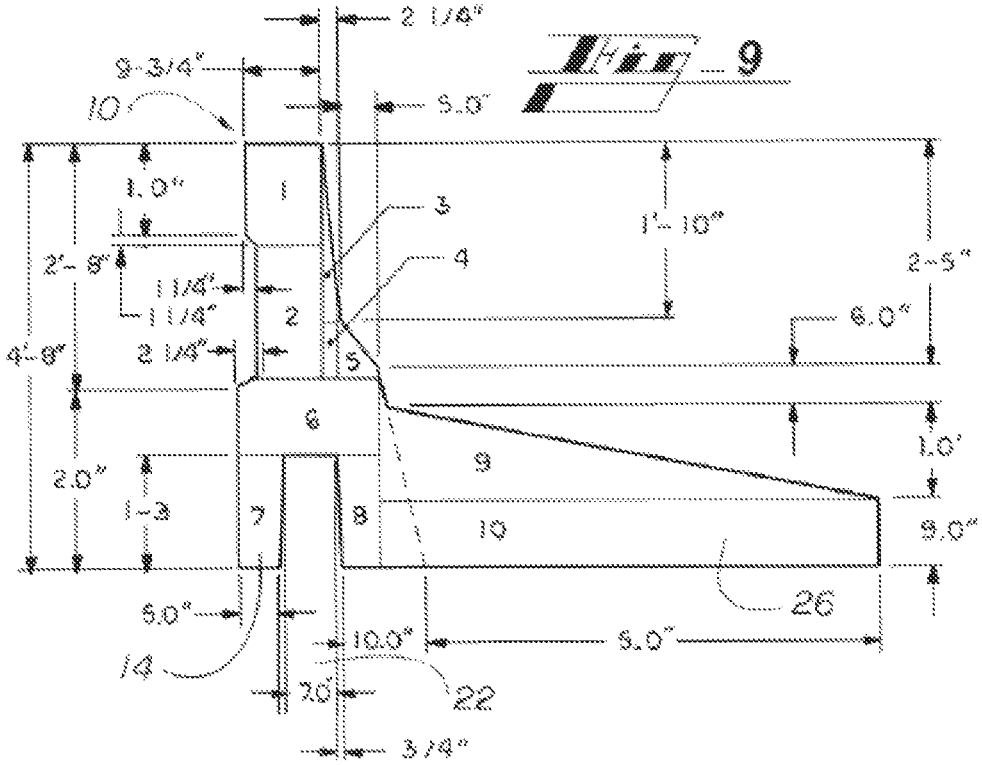
FIG. 9 is an end view of a traffic barrier according to an embodiment of the present disclosure, showing preferred dimension reference points and lines for assessment of impact tolerance; a FIG. 10 is a cross-sectional view of a traffic barrier according to an embodiment of the present disclosure, showing a barrier section carried on a top portion of an MSE wall and connected to a moment slab via a plurality of rebar elements.

And, further to check Section C-C of FIG. 9:

$d_b$−assume#6 bars=0.75 in $b_w$=15 ft

Computing the moment:

54 kips×3.79' per 15' of barrier=1204.66 kip-ft

Computing the depth of section:

$d=t-2''-(d_b/2)=18.63$ in $M_n=0.9\times[A_s\times f_y\times d(1-0.6p\times f_y/f'c)]/12$ p=$A_s/b_w\times d$ p=0.0003 $A_s$ 0.6 p=0.0002 $A_s$ Finally, solving Moment in terms of $A_s$:

$$12\times204.66=0.9A_s(60)(18.63)[1-0.0002As(60/5.5)]$$

$$2455.9=1006A_s-2.19A_s^2$$

$A_s$=2.46 in$^2$ $A_{s\ required}$=2.46 in$^2$ $$\#6\ @10''O.C.=0.53\ \text{in}^2/\text{ft}$$

Over 15' length, Total $A_{s\ provided}$=7.95 in$^2$ $A_{s\ provided}>A_{s\ required}$ To check shear:

$$V_c=2\times sqrt(f_c)\times b_w\times d=497.26\ \text{kips}$$

$V_u$=54 kips $V_c>V_u$

Temperature and Shrinkage Steel:

Per AASHTO section 8.20.1

⅛ square inch per foot in each direction $A_s$ required=0.125 in$^2$

Front face of barrier is W14.5 @ 6" O.C.

$A_s$ provided=0.29 in$^2$ $A_{s\ provided}>A_{s\ required}$

Moment slab uses #4 @ 12" O.C.

$A_{s\ provided}$=0.2 in$^2$ $A_{s\ provided}>A_{s\ required}$

Check Development Lengths:

Per AASHTO 8.29.2 development length for a hooked bar $$1200\times d_b/sqrt(fc)$$

Check hooked steel in moment slab

#5 10.11 in $I_{hb}$ required 12 in $I_{hb}$ required

#6 12.14 in $I_{hb}$ required 14 in $I_{hb}$ provided

Check development length for #5 bar $$[0.04A_b(f_y)]/sqrt(fc)$$

not less than 0.4 $d_bf_y$*1.4*0.8=16.80 in $I_d$ required 23 in $I_d$ provided

Check development length for #4 bar $$[0.04A_b(f_y)]/sqrt(fc)$$

not less than 0.4 $d_bf_y$*1.4*0.8=13.44 in $I_d$ required 18 in $I_d$ provided

Check development length for #6 bar $$[0.04A_b(f_y)]/sqrt(fc)$$

not less than 0.4 $d_bf_y$*1.4*0.8=20.16 in $I_d$ required 23 in $I_d$ provided

Check shear dowel capacity for adhesive anchors:

For one #11 bar

Per FDOT Structures Design Manual 1.6.4

$$0.85\times0.7\times Fy\times As=55.69\ \text{kips}$$

Shear required=54 kips (1) #11 bar is acceptable

Per FDOT Structures Design Manual 1.6.4

Embedment>6 $d_b$=8.25 in required 18 in provided

Clear distance>3 $d_b$=4.125 in required 4.125 in provided

Check Punching Shear Capacity of Concrete at Shear Dowels:

Assume 45° angle from edge of Shear Dowels

#11 bar is located 4.125" from each side of barrier

Below is the result of punching shear for both the front and rear face of the barrier:

$$1.0\times1.0\times0.4534\times c^{1.5}\times sqrt(fc)=8.9\ \text{kips}\ 2.0$$

For punching shear of the #11 dowel, the barrier will support a portion of the TL-4 loading. Assume impact hits at barrier joint over a 5' impact distance.

From above section A-A has the smallest shear capacity at 134 kips over the 10' barrier.

Use a 5' width:

Shear capacity at 5' width=113.85 kips

Shear capacity at joint=122.77 kips (barrier capacity plus punching shear capacity)

Factor of Safety=2.27 F.O.S.

As demonstrated, the presently described full precast traffic barrier 10 and installation method and mechanically stabilized earth wall structures, wherein reinforcing elements formed with adjoining concrete slabs (such as rebar) at an interface between the FPTB section and the slab provide a counter weight element to the slab and enable increased resistance to overturning upon impact, meeting TL-4 impact requirements.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A traffic barrier comprising:

a base including a wall port capable of receiving an existing earth wall therein, a first row of rebar coupled to said base and extending outwardly away therefrom, and a second row of rebar coupled to said base and extending outwardly away therefrom; and a moment slab connected to said first and second rows of rebar in such a manner that a proximal end of said moment slab directly abuts flush against an anterior side of said base;

wherein said first and second bases have lateral ends respectively provided with a hole form therein;

a threaded insert completely inserted within said hole of said first base;

a dowel having a threaded first end and second end;

an adhesive located within said hole of said second base;

wherein said threaded first end of said dowel is threadably coupled to said threaded insert and thereby located within said hole of said first base;

wherein said second end of said dowel is inserted into said hole of said second base and secured therein via said adhesive.

2. The traffic barrier of claim 1, wherein said first row of rebar comprises: a plurality of first rebar equidistantly spaced apart and configured parallel to horizontal lengths of said base and said moment slab, respectively;

wherein said first row of rebar is located at a height substantially equally to a height of a topmost end of said wall port;

wherein each of said first rebar are oriented substantially perpendicular to a vertical height of said base.

3. The traffic barrier of claim 2, wherein said wall port has an inner support wall located adjacent to said anterior side of said base;

wherein said first row of rebar is positioned proximate to said inner support wall.

4. The traffic barrier of claim 3, wherein said second row of rebar comprises: a plurality of second rebar equally spaced apart and oriented parallel to the horizontal length of said base;

wherein each of said second rebar is oriented perpendicular to the vertical height of said base.

5. A traffic barrier comprising:

a precast base including a wall port capable of receiving an existing earth wall therein, a first row of rebar coupled to said base and extending outwardly away therefrom, and a second row of rebar coupled to said base and extending outwardly away therefrom; and a moment slab connected to said first and second rows of rebar in such a manner that a proximal end of said moment slab directly abuts flush against an anterior side of said base;

wherein said first and second bases have lateral ends respectively provided with a hole form therein;

a threaded insert completely inserted within said hole of said first base;

a dowel having a threaded first end and second end;

an adhesive located within said hole of said second base;

wherein said threaded first end of said dowel is threadably coupled to said threaded insert and thereby located within said hole of said first base;

wherein said second end of said dowel is inserted into said hole of said second base and secured therein via said adhesive;

wherein said first and second bases are configured in an end-to-end pattern and form a junction between said lateral ends thereof, respectively.

6. The traffic barrier of claim 5, wherein said first row of rebar comprises: a plurality of first rebar equidistantly spaced apart and configured parallel to horizontal lengths of said base and said moment slab, respectively;

wherein said first row of rebar is located at a height substantially equally to a height of a topmost end of said wall port;

wherein each of said first rebar are oriented substantially perpendicular to a vertical height of said base.

7. The traffic barrier of claim 6, wherein said wall port has an inner support wall located adjacent to said anterior side of said base;

wherein said first row of rebar is positioned proximate to said inner support wall.

8. The traffic barrier of claim 7, wherein said second row of rebar comprises: a plurality of second rebar equally spaced apart and oriented parallel to the horizontal length of said base;

wherein each of said second rebar is oriented perpendicular to the vertical height of said base.

9. A method of forming a traffic barrier, said method comprising the steps of:

precasting and forming first and second bases at a location remote from a job site, each of said first and second bases including a wall port capable of receiving an existing earth wall therein, a first row of rebar coupled to said first and second bases and extending outwardly away therefrom, and a second row of rebar coupled to said first and second bases and extending outwardly away therefrom;

at the job site, angling said first row of rebar in an upward direction away from a ground surface;

at the job site, angling said second row of rebar in a downward direction towards the ground surface;

at the job site, pouring and forming a moment slab about said first and second rows of rebar;

at the job site, adjusting an angle of each of said first and second rows of rebar to remain inside an outer perimeter of said moment slab;

at the job site, connecting said moment slab to said first and second rows of rebar in such a manner that a proximal end of said moment slab directly abuts flush against an anterior side of a corresponding one of said first and second bases;

wherein said first and second bases have lateral ends respectively provided with a hole form therein;

providing and completely inserting a threaded insert within said hole of said first base;

providing a dowel having a threaded first end and second end;

providing and locating an adhesive within said hole of said second base;

threadably coupling said threaded first end of said dowel to said threaded insert and thereby locating said threaded first end within said hole of said first base;

inserting said second end of said dowel into said hole of said second base thereby securing said dowel via said adhesive; and configuring said first and second bases in an end-to-end pattern thereby forming a junction between said lateral ends of said first and second bases, respectively.

* * * * *